US011450283B2

(12) United States Patent
Kim et al.

(10) Patent No.: US 11,450,283 B2
(45) Date of Patent: Sep. 20, 2022

(54) PIXEL CIRCUIT AND DISPLAY APPARATUS HAVING THE SAME

(71) Applicant: Samsung Display Co., Ltd., Yongin-Si (KR)

(72) Inventors: Hyoung-Wook Kim, Hwaseong-si (KR); Dong In Kim, Suwon-si (KR); Bong Im Park, Hwaseong-si (KR); Woo Il Park, Yongin-si (KR); Yong-Jin Shin, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/193,093

(22) Filed: Mar. 5, 2021

(65) Prior Publication Data

US 2021/0280139 A1 Sep. 9, 2021

(30) Foreign Application Priority Data

Mar. 6, 2020 (KR) ..... 10-2020-0028647

(51) Int. Cl.
*G09G 3/3291* (2016.01)

(52) U.S. Cl.
CPC ... *G09G 3/3291* (2013.01); *G09G 2300/0819* (2013.01); *G09G 2320/0233* (2013.01); *G09G 2320/0295* (2013.01); *G09G 2320/043* (2013.01); *G09G 2320/045* (2013.01); *G09G 2330/028* (2013.01)

(58) Field of Classification Search
CPC ..... G09G 3/3291; G09G 3/3258; G09G 2300/0809; G09G 2300/0819; G09G 2320/0233; G09G 2320/0295; G09G 2320/043; G09G 2320/045; G09G 2330/028
USPC ..... 345/55
See application file for complete search history.

(56) References Cited

U.S. PATENT DOCUMENTS 10,872,568 B2 * 12/2020 Yuan ..... G09G 3/3266
2010/0188390 A1 * 7/2010 Min ..... G09G 3/3291 345/212
2011/0227505 A1 * 9/2011 Park ..... H05B 45/60 315/297

(Continued)

FOREIGN PATENT DOCUMENTS

KR 1020190070536 A 6/2019

*Primary Examiner* — Tom V Sheng
(74) *Attorney, Agent, or Firm* — Cantor Colburn LLP

(57) ABSTRACT

A pixel circuit includes a first pixel including a first switching element including a control electrode connected to a first node, an input electrode receiving a first power voltage and an output electrode connected to a second node, a second switching element including a control electrode receiving a first signal, an input electrode receiving a first data voltage and an output electrode connected to the first node, a first light emitting element including a first electrode connected to the second node and a second electrode receiving a second power voltage, a third switching element including a control electrode receiving a second signal, an input electrode connected to the second node and an output electrode connected to a third node and a fourth switching element including a control electrode receiving a third signal, an input electrode connected to the third node and an output electrode connected to a sensing line.

20 Claims, 9 Drawing Sheets

(56) References Cited

U.S. PATENT DOCUMENTS

| | | | | |
|---|---|---|---|---|
| 2015/0154913 | A1* | 6/2015 | Kim | G09G 3/3258 345/691 |
| 2016/0189630 | A1* | 6/2016 | Chang | G09G 3/3233 345/211 |
| 2017/0316737 | A1 | 11/2017 | Park | |
| 2018/0061293 | A1* | 3/2018 | Park | G09G 3/3225 |
| 2018/0061320 | A1* | 3/2018 | Kim | H01L 51/50 |
| 2020/0020278 | A1* | 1/2020 | Lee | G09G 3/3275 |
| 2020/0105191 | A1* | 4/2020 | Chen | G09G 3/006 |
| 2020/0184902 | A1* | 6/2020 | Kim | G09G 3/3233 |
| 2021/0335234 | A1* | 10/2021 | Yin | G09G 3/3233 |

* cited by examiner

PIXEL CIRCUIT AND DISPLAY APPARATUS HAVING THE SAME

This application claims priority to Korean Patent Application No. 10-2020-0028647, filed on Mar. 6, 2020, and all the benefits accruing therefrom under 35 U.S.C. § 119, the content of which in its entirety is herein incorporated by reference.

BACKGROUND

1. Technical Field

Example embodiments of the present inventive concept relate to a pixel circuit and a display apparatus including the pixel circuit. More particularly, example embodiments of the present inventive concept relate to a pixel circuit enhancing a compensation accuracy of a threshold voltage of a switching element of the pixel circuit and a display apparatus including the pixel circuit.

2. Description of the Related Art

Generally, a display apparatus includes a display panel and a display panel driver. The display panel includes a plurality of gate lines, a plurality of data lines and a plurality of pixels. The display panel driver includes a gate driver, a data driver, a driving controller and a power voltage generator. The gate driver outputs gate signals to the gate lines. The data driver outputs data voltages to the data lines. The driving controller controls the gate driver and the data driver. The power voltage generator provides a power voltage to the display panel.

SUMMARY

Due to differences of threshold voltages of switching elements between the pixels of the display panel, uniformity of a display image of the display panel may not be guaranteed. To compensate the differences of the threshold voltages of the switching elements between the pixels, a sensing switching element may be provided in the pixel of the display panel. When the voltage of the pixel is sensed by the sensing switching element to compensate the differences of the threshold voltages, the sensing accuracy may be decreased due to a damage of an adjacent pixel.

Example embodiments of the present inventive concept provide a pixel circuit including a first sensing switching element and a second sensing switching element connected to the first sensing switching element to enhance a compensation accuracy of a threshold voltage of a switching element of the pixel circuit.

Example embodiments of the present inventive concept also provide a display apparatus including the pixel circuit.

In an example embodiment of a pixel circuit according to the present inventive concept, the pixel circuit includes a first pixel. The first pixel includes a first switching element including a control electrode connected to a first node, an input electrode which receives a first power voltage and an output electrode connected to a second node, a second switching element including a control electrode which receives a first signal, an input electrode which receives a first data voltage and an output electrode connected to the first node, a first light emitting element including a first electrode connected to the second node and a second electrode which receives a second power voltage, a third switching element including a control electrode which receives a second signal, an input electrode connected to the second node and an output electrode connected to a third node and a fourth switching element including a control electrode which receives a third signal, an input electrode connected to the third node and an output electrode connected to a sensing line.

In an example embodiment, an active period of the third signal may overlap with an active period of the first data voltage.

In an example embodiment, the control electrode of the fourth switching element may be connected to the input electrode of the second switching element.

In an example embodiment, the pixel circuit may further include a second pixel and a third pixel. The second pixel may include a fifth switching element including a control electrode connected to a fourth node, an input electrode which receives the first power voltage and an output electrode connected to a fifth node, a sixth switching element including a control electrode which receives the first signal, an input electrode which receives a second data voltage having a phase different from a phase of the first data voltage, and an output electrode connected to the fourth node, a second light emitting element including a first electrode connected to the fifth node and a second electrode which receives the second power voltage, a seventh switching element including a control electrode which receives the second signal, an input electrode connected to the fifth node and an output electrode connected to a sixth node and an eighth switching element including a control electrode which receives a fourth signal, an input electrode connected to the sixth node and an output electrode connected to the sensing line. The third pixel may include a ninth switching element including a control electrode connected to a seventh node, an input electrode receiving the first power voltage and an output electrode connected to an eighth node, a tenth switching element including a control electrode which receives the first signal, an input electrode receiving a third data voltage having a phase different from either of the phase of the first data voltage and the phase of the second data voltage, and an output electrode connected to the seventh node, a third light emitting element including a first electrode connected to the eighth node and a second electrode which receives the second power voltage, an eleventh switching element including a control electrode which receives the second signal, an input electrode connected to the eighth node and an output electrode connected to a ninth node and a twelfth switching element including a control electrode receiving a fifth signal, an input electrode connected to the ninth node and an output electrode connected to the sensing line.

In an example embodiment, an active period of the third signal may overlap with an active period of the first data voltage. An active period of the fourth signal may overlap with an active period of the second data voltage. An active period of the fifth signal may overlap with an active period of the third data voltage.

In an example embodiment, the active period of the third signal, the active period of the fourth signal and the active period of the fifth signal may not overlap with one another.

In an example embodiment, the control electrode of the fourth switching element may be connected to the input electrode of the second switching element. The control electrode of the eighth switching element may be connected to the input electrode of the sixth switching element. The control electrode of the twelfth switching element may be connected to the input electrode of the tenth switching element.

In an example embodiment, the first light emitting element may represent a first color. The second light emitting element may represent a second color different from the first color. The third light emitting element may represent a third color different from either of the first color and the second color.

In an example embodiment of a display apparatus according to the present inventive concept, the display apparatus includes a display panel and a data driver. The display panel includes a first pixel and is configured to display an image. The data driver is configured to output a data voltage to the display panel and configured to receive a sensing voltage from the display panel. The first pixel includes a first switching element including a control electrode connected to a first node, an input electrode which receives a first power voltage and an output electrode connected to a second node, a second switching element including a control electrode which receives a first signal, an input electrode which receives a first data voltage and an output electrode connected to the first node, a first light emitting element including a first electrode connected to the second node and a second electrode which receives a second power voltage, a third switching element including a control electrode which receives a second signal, an input electrode connected to the second node and an output electrode connected to a third node and a fourth switching element including a control electrode which receives a third signal, an input electrode connected to the third node and an output electrode connected to a sensing line. The data driver includes a first switch including a first end connected to the sensing line and a second end which receives an initialization voltage, the first switch controlled by a first sensing signal and a second switch connected to the first switch and controlled by a second sensing signal.

In an example embodiment, an active period of the third signal may overlap with an active period of the first data voltage.

In an example embodiment, the control electrode of the fourth switching element may be connected to the input electrode of the second switching element.

In an example embodiment, the first signal, the second signal, the first data voltage, the third signal and the first sensing signal may have active statuses in a first period of a sensing period. The second sensing signal may have an inactive status in the first period of the sensing period.

In an example embodiment, the first signal, the second signal, the first data voltage, the third signal, the first sensing signal and the second sensing signal may have the active statuses in a second period of the sensing period subsequent to the first period.

In an example embodiment, the first signal, the second signal, the first data voltage, the third signal and the second sensing signal may have the active statuses in a third period of the sensing period subsequent to the second period. The first sensing signal may have the inactive status in the third period of the sensing period.

In an example embodiment, the first signal, the second signal, the first data voltage and the third signal may have the active statuses in a fourth period of the sensing period subsequent to the third period. The first sensing signal and the second sensing signal may have the inactive statuses in the fourth period of the sensing period.

In an example embodiment, the first signal may be applied to the first pixel in a scanning driving method in a driving period. The first data voltage and the third signal may have a value corresponding to a desired grayscale value of the first pixel in the driving period. The second signal, the first sensing signal and the second sensing signal may have the inactive statuses in the driving period.

In an example embodiment, the display apparatus may further include a driving controller which determines a threshold voltage of the first switching element of the first pixel based on the sensing voltage received from the sensing line and compensates a data signal based on the threshold voltage.

In an example embodiment, the display panel may further include a second pixel and a third pixel. The second pixel may include a fifth switching element including a control electrode connected to a fourth node, an input electrode which receives the first power voltage and an output electrode connected to a fifth node, a sixth switching element including a control electrode which receives the first signal, an input electrode which receives a second data voltage having a phase different from a phase of the first data voltage, and an output electrode connected to the fourth node, a second light emitting element including a first electrode connected to the fifth node and a second electrode which receives the second power voltage, a seventh switching element including a control electrode which receives the second signal, an input electrode connected to the fifth node and an output electrode connected to a sixth node and an eighth switching element including a control electrode which receives a fourth signal, an input electrode connected to the sixth node and an output electrode connected to the sensing line. The third pixel may include a ninth switching element including a control electrode connected to a seventh node, an input electrode receiving the first power voltage and an output electrode connected to an eighth node, a tenth switching element including a control electrode which receives the first signal, an input electrode receiving a third data voltage having a phase different from either of the phase of the first data voltage and the phase of the second data voltage, and an output electrode connected to the seventh node, a third light emitting element including a first electrode connected to the eighth node and a second electrode which receives the second power voltage, an eleventh switching element including a control electrode which receives the second signal, an input electrode connected to the eighth node and an output electrode connected to a ninth node and a twelfth switching element including a control electrode receiving a fifth signal, an input electrode connected to the ninth node and an output electrode connected to the sensing line.

In an example embodiment, an active period of the third signal may overlap with an active period of the first data voltage. An active period of the fourth signal may overlap with an active period of the second data voltage. An active period of the fifth signal may overlap with an active period of the third data voltage.

In an example embodiment, the active period of the third signal, the active period of the fourth signal and the active period of the fifth signal may not overlap with one another.

According to the pixel circuit and the display apparatus including the pixel circuit, the pixel includes the first sensing switching element and the second sensing switching element connected to the first sensing switching element in series. The control signal of the second sensing switching element has an active period overlapped with the data voltage of the pixel such that the sensing accuracy of the voltage of the pixel may be enhanced. Thus, the compensation accuracy of the threshold voltage of the switching element of the pixel may be enhanced such that the display quality of the display panel may be enhanced.

BRIEF DESCRIPTION OF THE DRAWINGS

The above and other features and advantages of the present inventive concept will become more apparent by describing in detailed example embodiments thereof with reference to the accompanying drawings, in which.

DETAILED DESCRIPTION

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. Hereinafter, the present inventive concept will be explained in detail with reference to the accompanying drawings.

Figure 1:
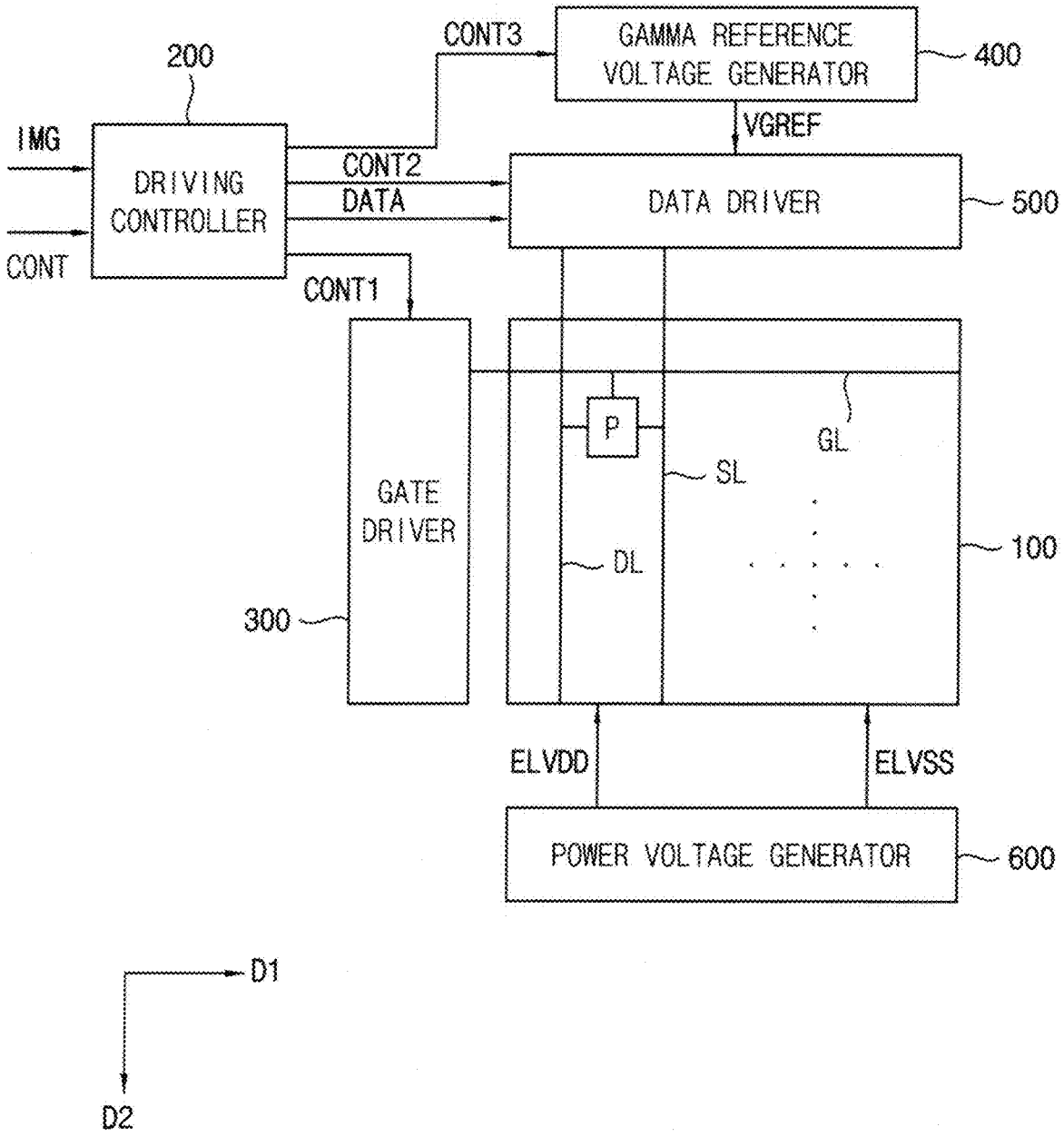
FIG. 1 is a block diagram illustrating a display apparatus according to an example embodiment of the present inventive concept.

FIG. 1 is a block diagram illustrating a display apparatus according to an example embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500. The display panel driver further includes a power voltage generator 600.

In an example embodiment, for example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 which are integrally formed may be called to a timing controller embedded data driver ("TED").

The display panel 100 has a display region on which an image is displayed and a peripheral region adjacent to the display region.

The display panel 100 includes a plurality of gate lines GL, a plurality of data lines DL and a plurality of pixels P connected to the gate lines GL and the data lines DL. The gate lines GL extend in a first direction D1 and the data lines DL extend in a second direction D2 crossing the first direction D1. The display panel 100 may further include a plurality of sensing lines SL connected to the pixels P.

In an example embodiment, the display panel 100 may be an organic light emitting display panel including organic light emitting elements.

The driving controller 200 receives input image data IMG and an input control signal CONT from an external apparatus. The input image data IMG may include red image data, green image data and blue image data. The input image data IMG may include white image data. The input image data IMG may include magenta image data, yellow image data and cyan image data in another example embodiment. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. For example, the gate driver 300 may be integrated on the peripheral region of the display panel 100. In another example embodiment, for example, the gate driver 300 may be mounted on the peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The power voltage generator 600 may generate a power voltage for driving at least one of the display panel 100, the driving controller 200, the gate driver 300, the gamma reference voltage generator 400 and the data driver 500.

In an example embodiment, for example, the power voltage generator 600 may generate a first power voltage ELVDD and a second power voltage ELVSS applied to the pixel P of the display panel 100 and outputs the first power voltage ELVDD and the second power voltage ELVSS to the display panel 100. The second power voltage ELVSS may be less than the first power voltage ELVDD.

Figure 2:
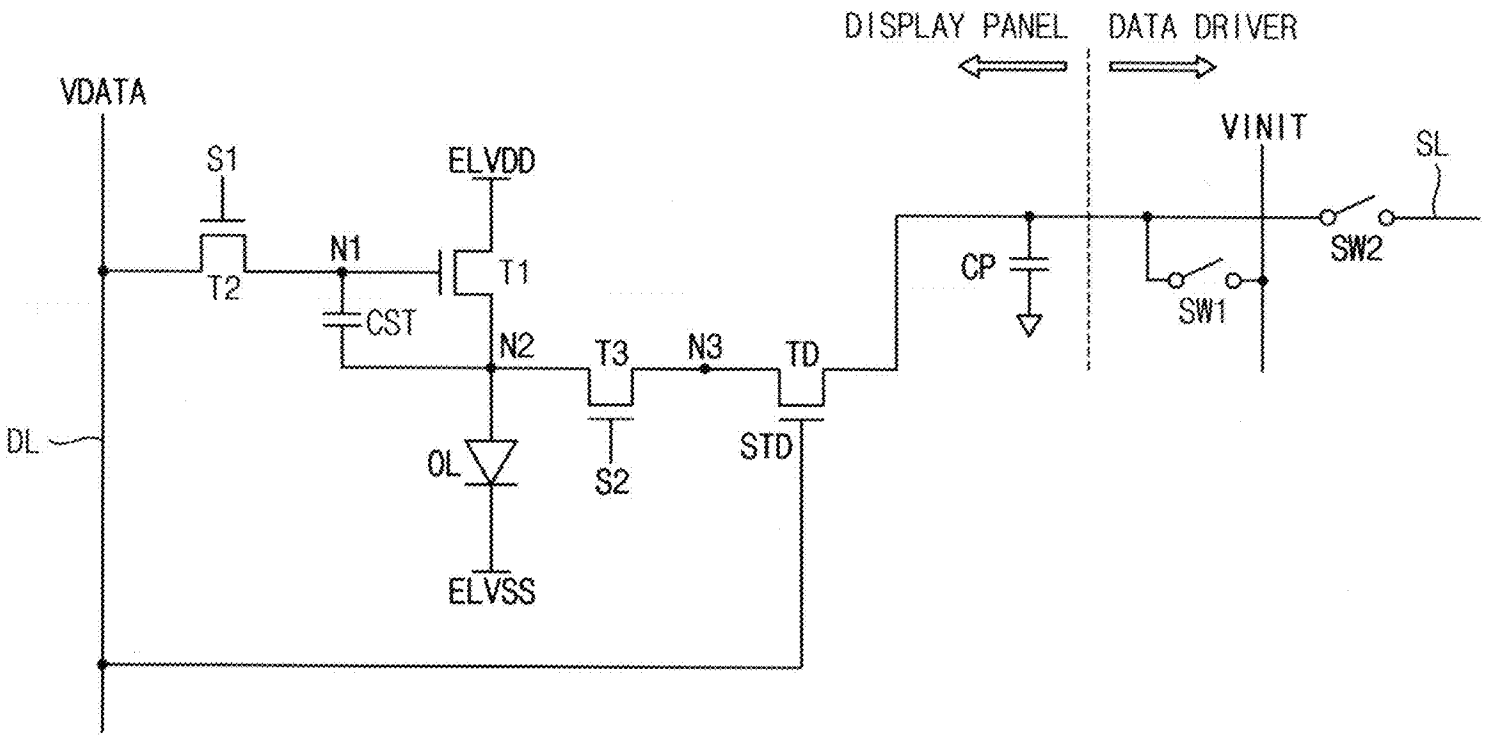
FIG. 2 is a circuit diagram illustrating a pixel of a display panel of FIG. 1 and a voltage sensor of a data driver of FIG. 1.
Figure 3:
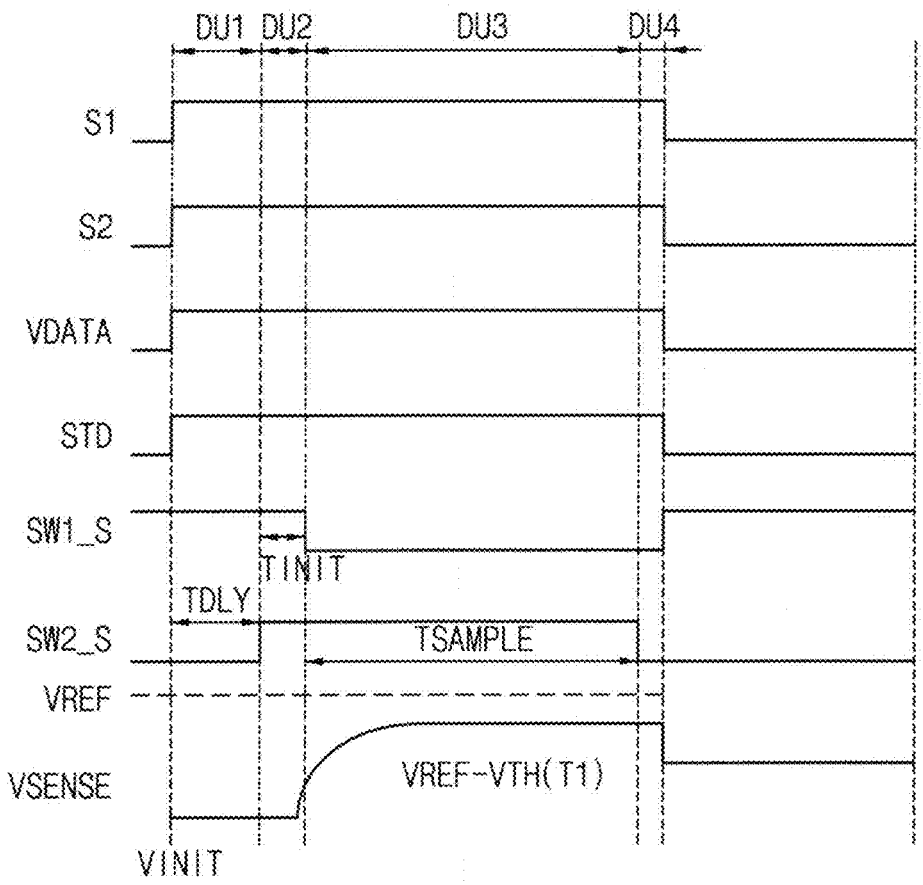
FIG. 3 is a timing diagram illustrating input and output signals of the pixel and the voltage sensor of FIG. 2 in a sensing period.

FIG. 2 is a circuit diagram illustrating the pixel P of the display panel 100 of FIG. 1 and a voltage sensor of the data driver 500 of FIG. 1. FIG. 3 is a timing diagram illustrating input and output signals of the pixel P and the voltage sensor of FIG. 2 in a sensing period.

Referring to FIGS. 1 to 3, at least one of the pixels P of the display panel 100 includes a first switching element T1, a second switching element T2, a first light emitting element OL, a third switching element T3, and a fourth switching element TD. The first switching element T1 includes a control electrode connected to a first node N1, an input electrode receiving the first power voltage ELVDD and an output electrode connected to a second node N2. The second switching element T2 includes a control electrode receiving a first signal S1, an input electrode receiving a first data voltage VDATA and an output electrode connected to the first node N1. The first light emitting element OL includes a first electrode connected to the second node N2 and a second electrode receiving the second power voltage ELVSS. The third switching element T3 includes a control electrode receiving a second signal S2, an input electrode connected to the second node N2 and an output electrode connected to a third node N3. The fourth switching element TD includes a control electrode receiving a third signal STD, an input electrode connected to the third node N3 and an output electrode connected to a sensing line SL.

The pixel P may further include a storage capacitor CST including a first electrode connected to the first node N1 and a second electrode connected to the second node N2. In addition, a parasitic capacitance of the display panel 100 is referred as "CP."

The data driver 500 may output the data voltage VDATA to the display panel 100. In addition, the data driver 500 may receive a sensing voltage VSENSE from the display panel 100. For example, the voltage sensor of the data driver 500 may receive the sensing voltage VSENSE.

The data driver 500 may output the data voltage VDATA to the display panel 100 in a driving period. The data driver 500 may receive the sensing voltage VSENSE from the display panel 100 in a sensing period. The sensing operation in the sensing period may be for obtaining a compensation value of a threshold voltage to compensate differences of threshold voltages of the pixels among the pixels of the display panel 100. In an example embodiment, the sensing operation may be operated in a manufacturing step of the display apparatus, but may not be operated in a normal operation of the display apparatus. Alternatively, the sensing operation may be operated in an initial period (e.g. a power-on period) of the display panel 100. Alternatively, the sensing operation may be operated between the driving periods in a predetermined cycle.

The data driver 500 may include a first switch including a first end connected to the sensing line SL and a second end receiving an initialization voltage VINIT and controlled by a first sensing signal SW1 and a second switch connected to the first switch and controlled by a second sensing signal SW2.

In the present example embodiment, an active period of the third signal STD may overlap with an active period of the first data voltage VDATA. As shown in FIG. 2, in the present example embodiment, the control electrode of the fourth switching element TD is connected to the input electrode of the second switching element T2 such that the active period of the third signal STD may be the same as the active period of the first data voltage VDATA. In other word, the third signal STD may be the same as the first data voltage VDATA.

In a first period DU1 of the sensing period, the first signal S1, the second signal S2, the first data voltage VDATA, the third signal STD and the first sensing signal SW1 may have active statuses, and the second sensing signal SW2 may have an inactive status. For example, the first period DU1 may be referred to a delay period TDLY.

During the first period DU1, the initialization voltage VINIT may be applied to the pixel P. During the first period DU1, the initialization voltage VINIT may be applied to the output electrode of the first switching element T1, and a reference voltage VREF may be applied to the control electrode of the first switching element T1. Herein, for example, the first data voltage VDATA may be the reference voltage VREF.

During a second period DU2 of the sensing period subsequent to the first period DU1, the first signal S1, the second signal S2, the first data voltage VDATA, the third signal STD, the first sensing signal SW1 and the second sensing signal SW2 may have active statuses. For example, the second period DU2 may be referred to an initialization period TINIT.

During the second period DU2, the initialization voltage VINIT may be applied to the pixel and the level of the parasitic capacitance CP of the display panel 100 may be initialized to the initialization voltage VINIT.

During a third period DU3 of the sensing period subsequent to the second period DU2, the first signal S1, the second signal S2, the first data voltage VDATA, the third signal STD and the second sensing signal SW2 may have active statuses, and the first sensing signal SW1 may have an inactive status. For example, the third period DU3 may be referred to a sampling period TSAMPLE.

During the third period DU3, the first switching element T1 operates as a source follower such that the sensing voltage VSENSE of the sensing line SL may be charged to a value VREF-VTH(T1). Here, VTH(T1) is a threshold voltage of the first switching element T1, and the value VREF-VTH(T1) is the value generated by subtracting the threshold voltage VTH(T1) of the first switching element T1 from the reference voltage VREF.

During a fourth period DU4 of the sensing period subsequent to the third period DU3, the first signal S1, the second signal S2, the first data voltage VDATA and the third signal STD may have active statuses, and the first sensing signal SW1 and the second sensing signal SW2 may have inactive statuses.

During the fourth period DU4, the sensing voltage VSENSE may be sensed. The threshold voltage VTH(T1) of the first switching element T1 may be determined based on the sensing voltage VSENSE.

Figure 4:
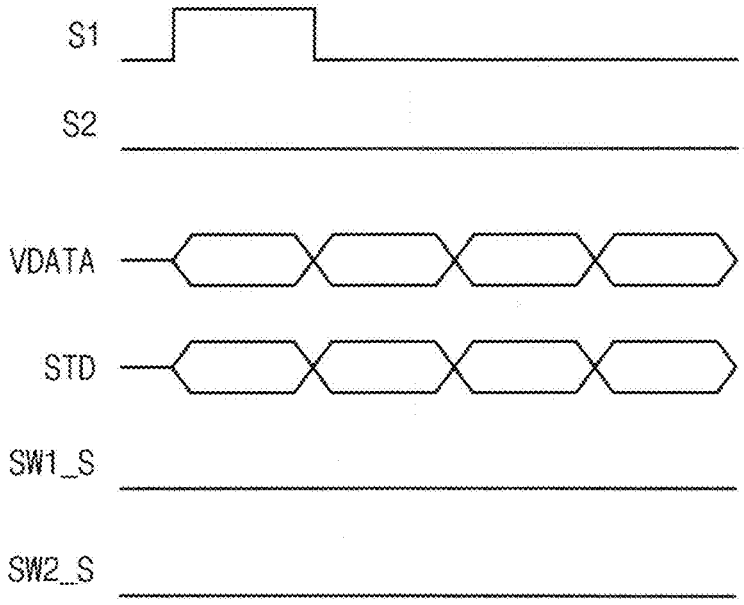
FIG. 4 is a timing diagram illustrating the input signals of the pixel and the voltage sensor of FIG. 2 in a driving period.

FIG. 4 is a timing diagram illustrating the input signals of the pixel and the voltage sensor of FIG. 2 in the driving period.

Referring to FIGS. 1 to 4, the driving controller 200 may determine the threshold voltages VTH(T1) of the first switching elements T1 of the pixels based on the sensing voltage VSENSE received from the sensing line SL and may compensate the data signal DATA based on the threshold voltages VTH(T1).

The driving controller 200 may output the data signal DATA for compensating the threshold voltage difference to the data driver 500. The data driver 500 may convert the data signal DATA into the data voltage VDATA and may output the data voltage VDATA to the display panel 100.

During the driving period, the first signal S1 may be a gate signal of the pixel P such that the first signal S1 may have the corresponding driving timing of the pixel P so that the display panel 100 may be driven in a scanning driving method.

During the driving period, the first data voltage VDATA and the third signal STD may be the data voltage of the pixel P such that each of the first data voltage VDATA and the third signal STD may have the value corresponding to a desired grayscale value of the pixel P.

During the driving period, the second signal S2 may have an inactive status. During the driving period, the third switching element T3 may be turned off in response to the second signal S2 having the inactive status such that the third switching element T3 and the fourth switching element T4 do not affect the operation of the pixel P during the driving period. In addition, during the driving period, the first sensing signal SW1 and the second sensing signal SW2 may have inactive statuses.

According to the present example embodiment, the pixel P includes the third switching element T3 (i.e., first sensing switching element) and the fourth switching element TD (i.e., second sensing switching element) connected to the third switching element T3 in series. The third signal STD of the fourth switching element TD has an active period overlapped with the data voltage VDATA of the pixel P such that the sensing accuracy of the voltage of the pixel P may be enhanced. Thus, the compensation accuracy of the threshold voltage VTH(T1) of the switching element T1 of the pixel P may be enhanced such that the display quality of the display panel 100 may be enhanced.

Figure 5:
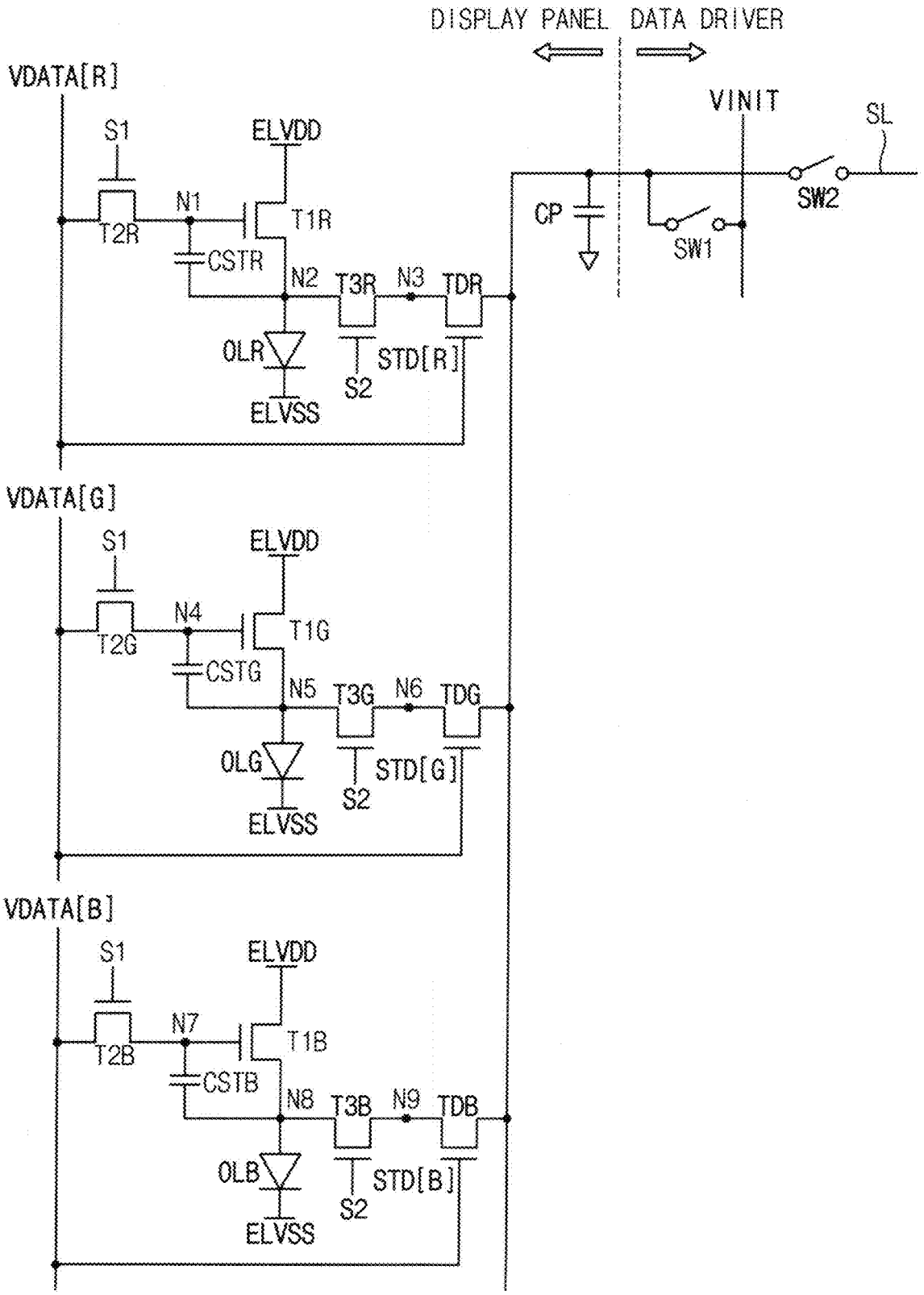
FIG. 5 is a circuit diagram illustrating a pixel of a display panel and a voltage sensor of a data driver according to an example embodiment of the present inventive concept.
Figure 6:
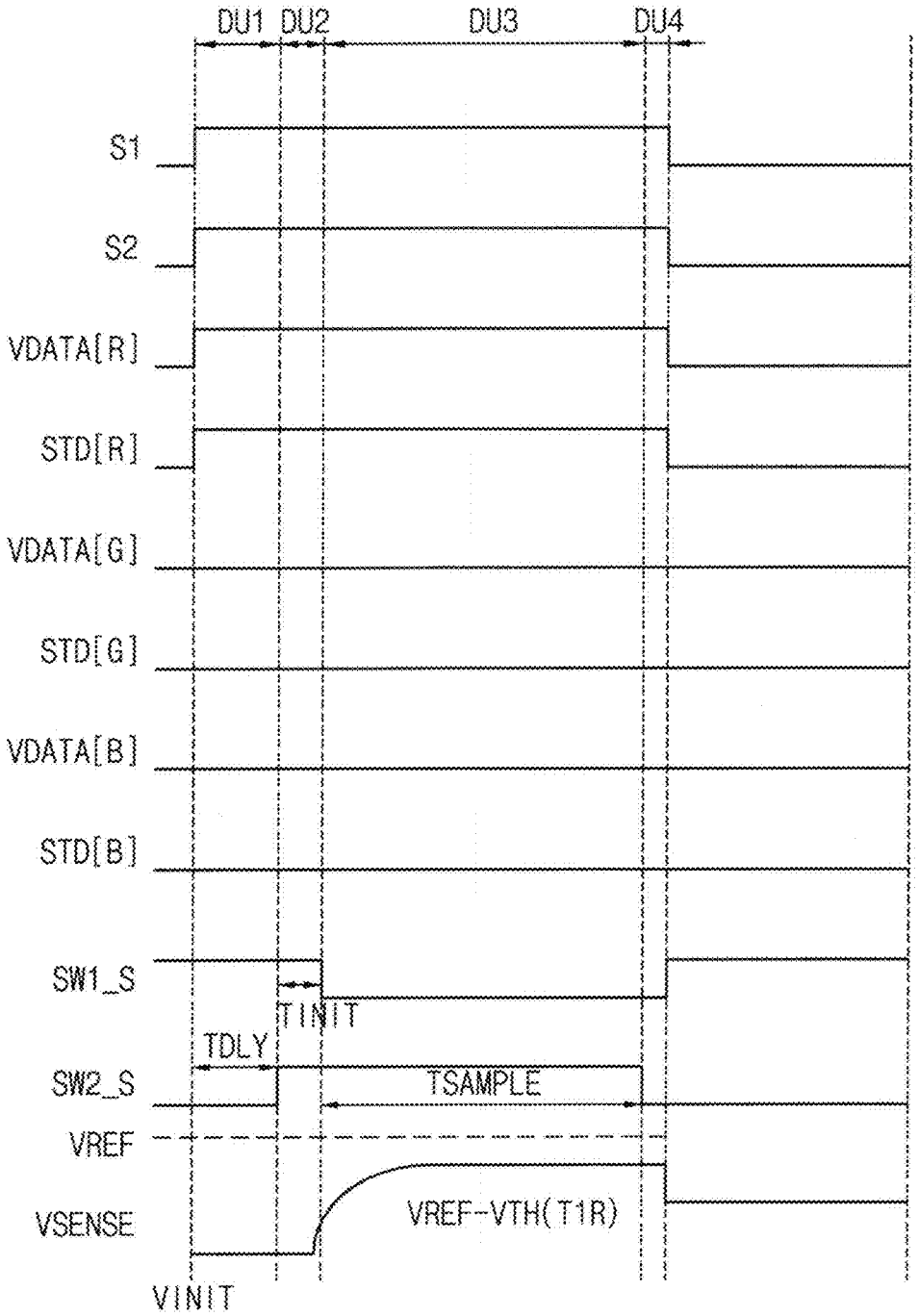
FIG. 6 is a timing diagram illustrating input and output signals of the pixel and the voltage sensor of FIG. 5 in a first sensing period.
Figure 7:
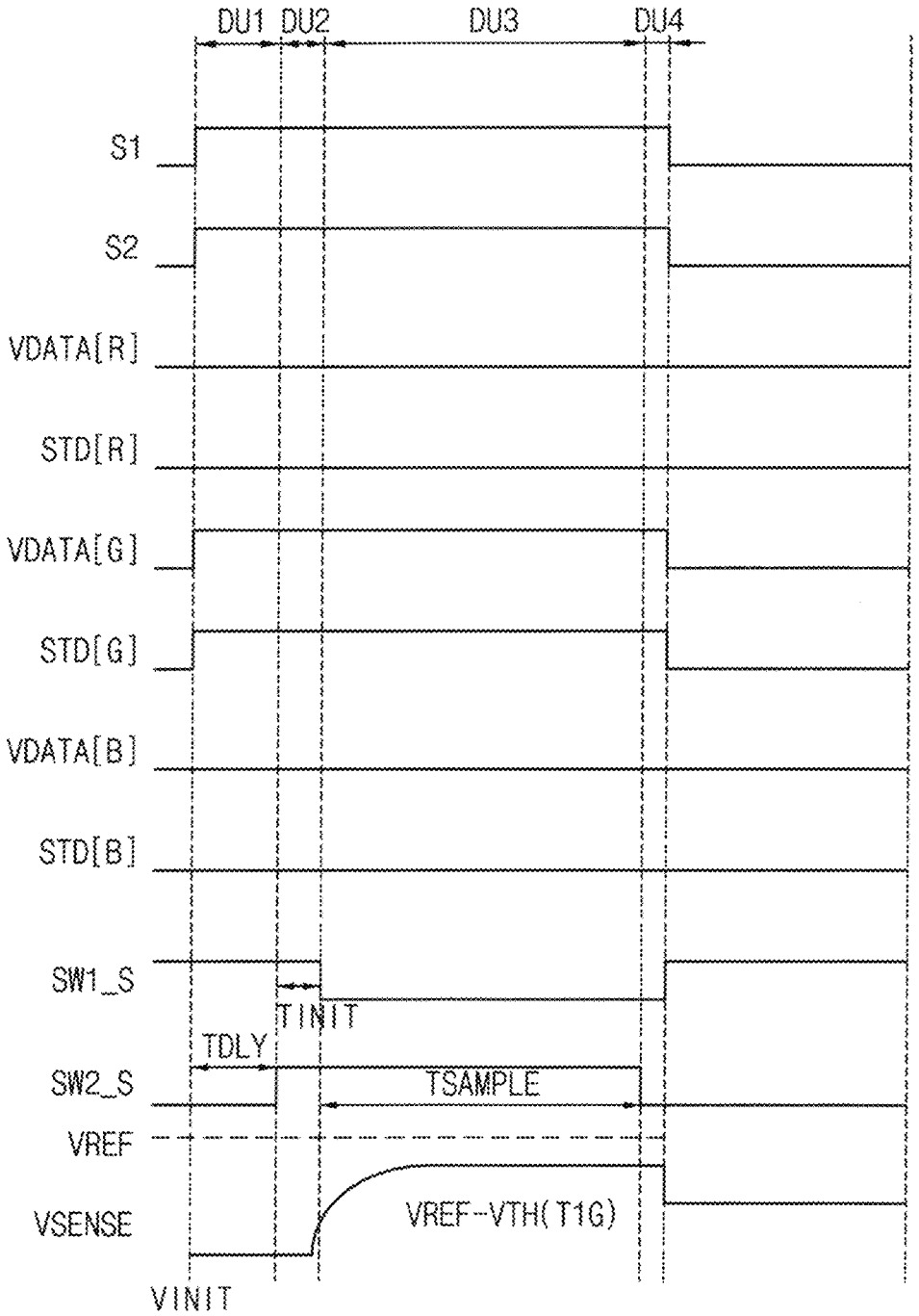
FIG. 7 is a timing diagram illustrating the input and output signals of the pixel and the voltage sensor of FIG. 5 in a second sensing period.
Figure 8:
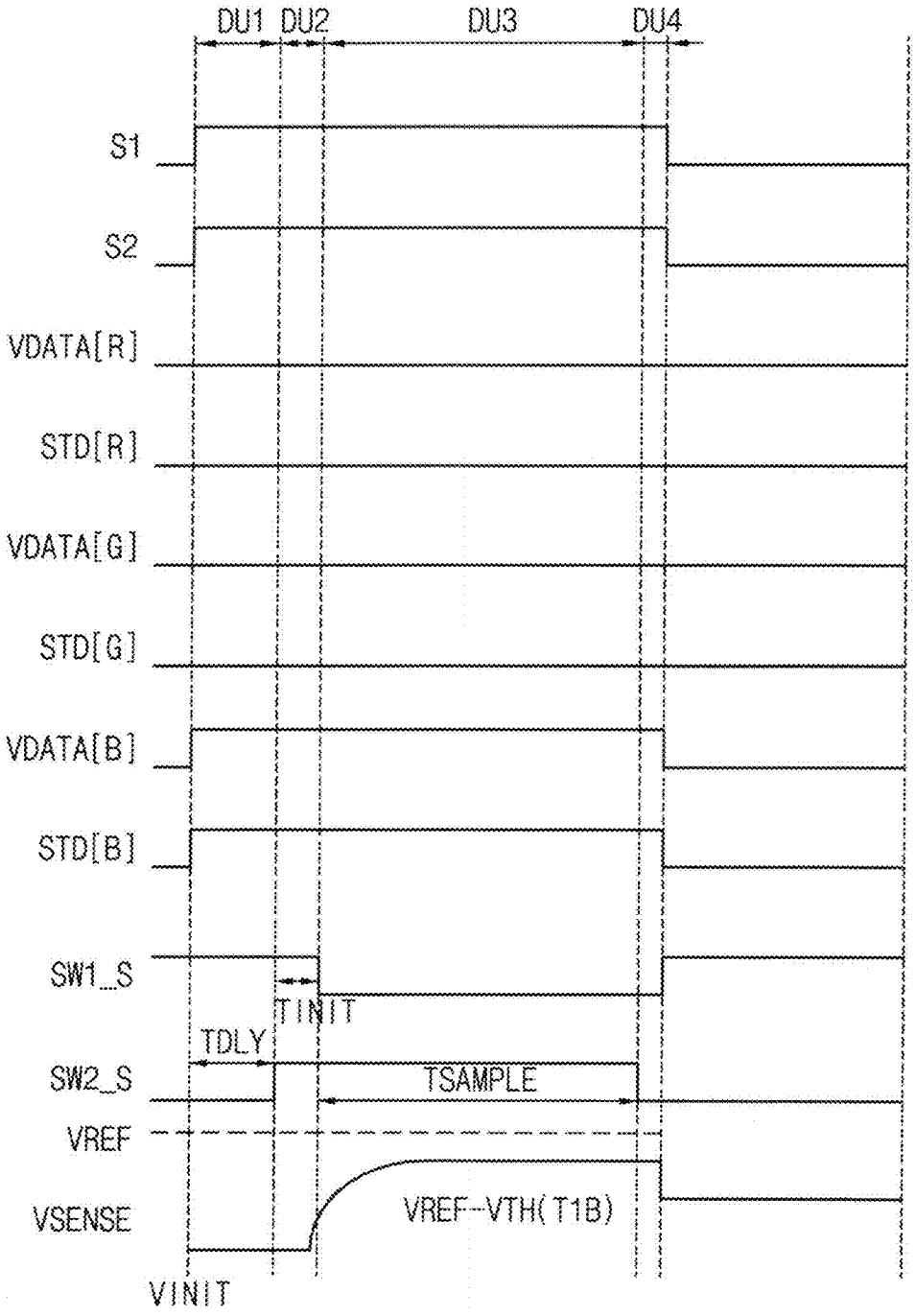
FIG. 8 is a timing diagram illustrating the input and output signals of the pixel and the voltage sensor of FIG. 5 in a third sensing period.

FIG. 5 is a circuit diagram illustrating a pixel of a display panel and a voltage sensor of a data driver according to an example embodiment of the present inventive concept. FIG. 6 is a timing diagram illustrating input and output signals of the pixel and the voltage sensor of FIG. 5 in a first sensing period. FIG. 7 is a timing diagram illustrating the input and output signals of the pixel and the voltage sensor of FIG. 5 in a second sensing period. FIG. 8 is a timing diagram illustrating the input and output signals of the pixel and the voltage sensor of FIG. 5 in a third sensing period.

The display apparatus according to the present example embodiment is substantially the same as the display apparatus according to the previous example embodiment explained referring to FIGS. 1 to 4 except for the structure of the pixel circuit. Thus, the same reference numerals will be used to refer to the same or like parts as those described in the previous example embodiment of FIGS. 1 to 4 and any repetitive explanation concerning the above elements will be omitted.

Referring to FIGS. 1 and 3 to 8, the display apparatus includes a display panel 100 and a display panel driver. The display panel driver includes a driving controller 200, a gate driver 300, a gamma reference voltage generator 400 and a data driver 500. The display panel driver further includes a power voltage generator 600.

In the present example embodiment, a first pixel, a second pixel and a third pixel of the display panel 100 may be connected to a single sensing line SL.

The first pixel includes a first switching element T1R, a second switching element T2R, a first light emitting element OLR, a third switching element T3R, and a fourth switching element TDR. The first switching element T1R includes a control electrode connected to a first node N1, an input electrode receiving the first power voltage ELVDD and an output electrode connected to a second node N2. The second switching element T2R includes a control electrode receiving a first signal S1, an input electrode receiving a first data voltage VDATA[R] and an output electrode connected to the first node N1. The first light emitting element OLR includes a first electrode connected to the second node N2 and a second electrode receiving the second power voltage ELVSS. The third switching element T3R (i.e., first sensing switching element) includes a control electrode receiving a second signal S2, an input electrode connected to the second node N2 and an output electrode connected to a third node N3. The fourth switching element TDR (i.e., second sensing switching element) includes a control electrode receiving a third signal STD[R], an input electrode connected to the third node N3 and an output electrode connected to a sensing line SL.

The first pixel may further include a storage capacitor CSTR including a first electrode connected to the first node N1 and a second electrode connected to the second node N2.

The second pixel includes a fifth switching element T1G, a sixth switching element T2G, a second light emitting element OLG, a seventh switching element T3G, and an eighth switching element TDG. The fifth switching element T1G includes a control electrode connected to a fourth node N4, an input electrode receiving the first power voltage ELVDD and an output electrode connected to a fifth node N5. The sixth switching element T2G includes a control electrode receiving the first signal S1, an input electrode receiving a second data voltage VDATA[G] and an output electrode connected to the fourth node N4. The second light emitting element OLG includes a first electrode connected to the fifth node N5 and a second electrode receiving the second power voltage ELVSS. The seventh switching element T3G (i.e., first sensing switching element) includes a control electrode receiving the second signal S2, an input electrode connected to the fifth node N5 and an output electrode connected to a sixth node N6. The eighth switching element TDG (i.e., second sensing switching element) includes a control electrode receiving a fourth signal STD [G], an input electrode connected to the sixth node N6 and an output electrode connected to the sensing line SL.

The second pixel may further include a storage capacitor CSTG including a first electrode connected to the fourth node N4 and a second electrode connected to the fifth node N5.

The third pixel includes a ninth switching element T1B, a tenth switching element T2B, a third light emitting element OLB, an eleventh switching element T3B, and a twelfth switching element TDB. The ninth switching element T1B includes a control electrode connected to a seventh node N7, an input electrode receiving the first power voltage ELVDD and an output electrode connected to an eighth node N8. The tenth switching element T2B includes a control electrode receiving the first signal S1, an input electrode receiving a third data voltage VDATA[B] and an output electrode connected to the seventh node N7. The third light emitting element OLB includes a first electrode connected to the eighth node N8 and a second electrode receiving the second power voltage ELVSS. The eleventh switching element T3B (i.e., first sensing switching element) includes a control electrode receiving the second signal S2, an input electrode connected to the eighth node N8 and an output electrode connected to a ninth node N9. The twelfth switching element TDB (i.e., second sensing switching element) includes a control electrode receiving a fifth signal STD[B], an input electrode connected to the ninth node N9 and an output electrode connected to the sensing line SL.

The third pixel may further include a storage capacitor CSTB including a first electrode connected to the seventh node N7 and a second electrode connected to the eighth node N8.

During the sensing period, the first data voltage VDATA [R] may be a test voltage for sensing the first pixel, the second data voltage VDATA[G] may be a test voltage for sensing the second pixel and the third data voltage VDATA [B] may be a test voltage for sensing the third pixel. The first data voltage VDATA[R], the second data voltage VDATA [G] and the third data voltage VDATA[B] may have different phases (i.e., different active periods) from one another.

During the driving period, the first data voltage VDATA [R] may be a grayscale voltage for displaying an image on the first pixel, the second data voltage VDATA[G] may be a grayscale voltage for displaying an image on the second pixel, and the third data voltage VDATA[B] may be a grayscale voltage for displaying an image on the third pixel.

The sensing period may include a first sensing period for sensing the sensing voltage VSENSE of the first pixel, a second sensing period for sensing the sensing voltage VSENSE of the second pixel and a third sensing period for sensing the sensing voltage VSENSE of the third pixel.

During the first sensing period shown in FIG. 6, the third signal STD[R] and the first data voltage VDATA[R] may have active statuses, and the fourth signal STD[G], the second data voltage VDATA[G], the fifth signal STD[B] and the third data voltage VDATA[B] may have inactive statuses. The operation of the first pixel in the first sensing period in FIG. 6 may be substantially the same as the operation of the pixel in the sensing period explained referring to FIG. 3.

During the second sensing period shown in FIG. 7, the fourth signal STD[G] and the second data voltage VDATA [G] may have active statuses, and the third signal STD[R], the first data voltage VDATA[R], the fifth signal STD[B] and the third data voltage VDATA[B] may have inactive statuses. The operation of the second pixel in the second sensing period in FIG. 7 may be substantially the same as the operation of the pixel in the sensing period explained referring to FIG. 3.

During the third sensing period shown in FIG. 8, the fifth signal STD[B] and the third data voltage VDATA[B] may have active statuses, and the third signal STD[R], the first data voltage VDATA[R], the fourth signal STD[G] and the second data voltage VDATA[G] may have inactive statuses. The operation of the third pixel in the third sensing period in FIG. 8 may be substantially the same as the operation of the pixel in the sensing period explained referring to FIG. 3.

In the present example embodiment, an active period of the third signal STD[R] may overlap with an active period of the first data voltage VDATA[R], an active period of the fourth signal STD[G] may overlap with an active period of the second data voltage VDATA[G], and an active period of the fifth signal STD[B] may overlap with an active period of the third data voltage VDATA[B].

As shown in FIG. 5, in the present example embodiment, the control electrode of the fourth switching element TDR (i.e., second sensing switching element) is connected to the input electrode of the second switching element T2R such that the active period of the third signal STD[R] may be the same as the active period of the first data voltage VDATA [R]. In addition, the control electrode of the eighth switching element TDG (i.e., second sensing switching element) is connected to the input electrode of the sixth switching element T2G such that the active period of the fourth signal STD[G] may be the same as the active period of the second data voltage VDATA[G]. In addition, the control electrode of the twelfth switching element TDB (i.e., second sensing switching element) is connected to the input electrode of the tenth switching element T2B such that the active period of the fifth signal STD[B] may be the same as the active period of the third data voltage VDATA[B].

The active period of the third signal STD[R], the active period of the fourth signal STD[G] and the active period of the fifth signal STD[B] may not overlap with one another.

In the present example embodiment, the first light emitting element OLR may represent a first color, the second light emitting element OLG may represent a second color different from the first color, and the third light emitting element OLB may represent a third color different from either of the first color and the second color. For example, the first color may be red, the second color may be green, and the third color may be blue.

According to the present example embodiment, the pixel includes the first sensing switching element T3R, T3G and T3B and the second sensing switching element TDR, TDG and TDB connected to the first sensing switching element T3R, T3G and T3B in series. The control signal STD[R], STD[G] and STD[B] of the second sensing switching element TDR, TDG and TDB has an active period overlapped with the active period of the data voltage VDATA[R], VDATA[G] and VDATA[B] of the pixel such that the sensing accuracy of the voltage of the pixel may be enhanced. Thus, the compensation accuracy of the threshold voltage VTH(T1R), VTH(T1G) and VTH(T1B) of the switching element T1R, T1G and T1B of the pixel P may be enhanced such that the display quality of the display panel 100 may be enhanced.

Figure 9:
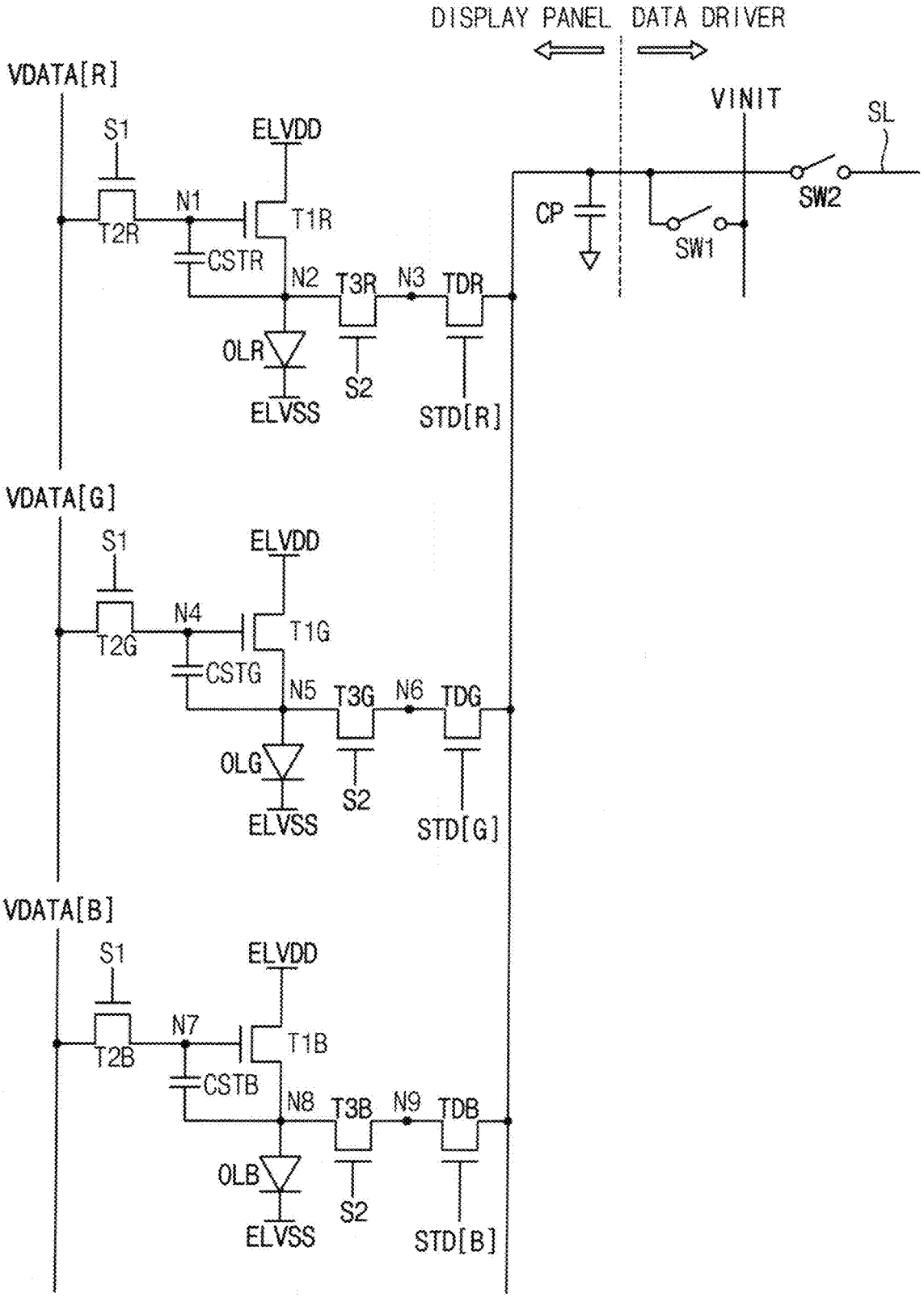
FIG. 9 is a circuit diagram illustrating a pixel of a display panel and a voltage sensor of a data driver according to another example embodiment of the present inventive concept.
Figure 10:
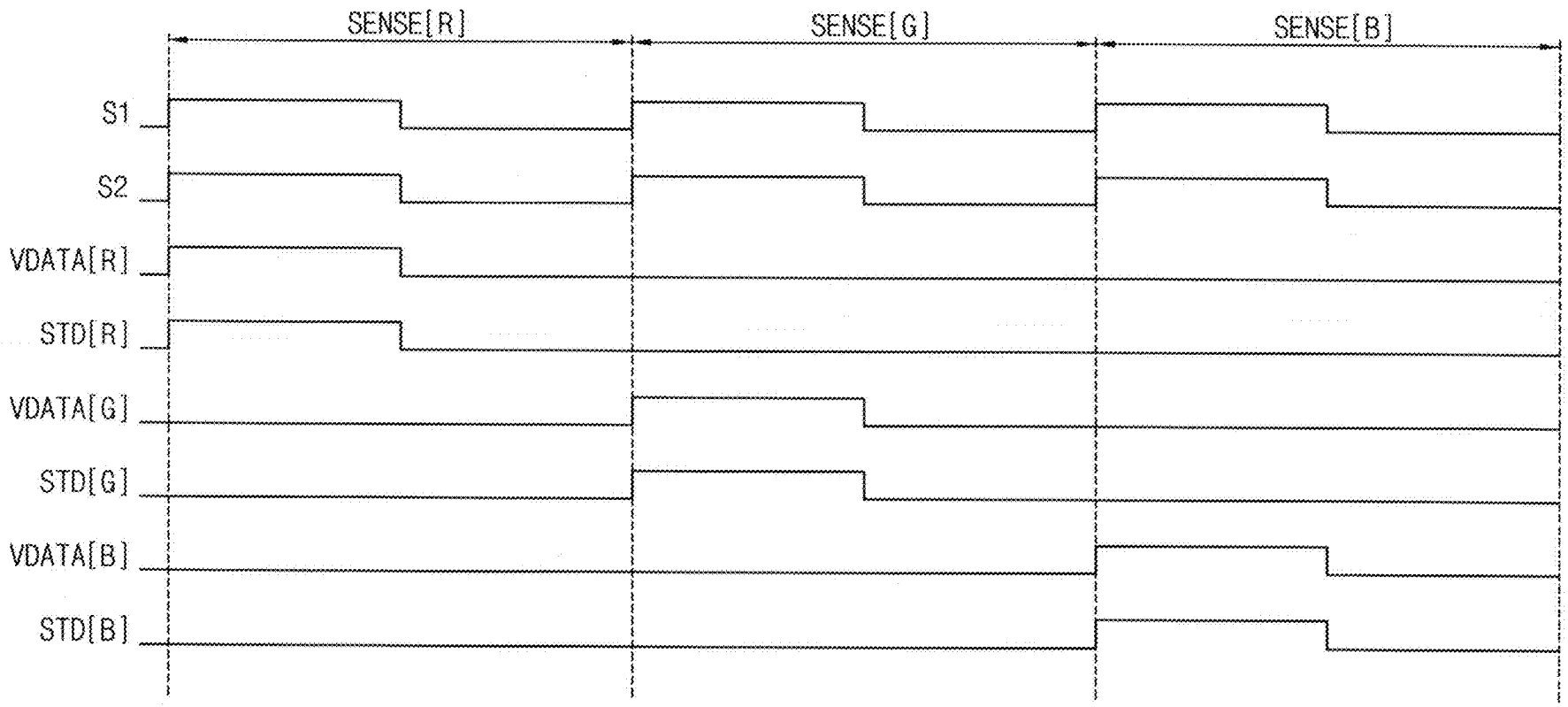
FIG. 10 is a timing diagram illustrating input signals of the pixel of FIG. 9 in a sensing period.

FIG. 9 is a circuit diagram illustrating a pixel of a display panel and a voltage sensor of a data driver according to another example embodiment of the present inventive concept. FIG. 10 is a timing diagram illustrating input signals of the pixel of FIG. 9 in a sensing period.

The display apparatus according to the present example embodiment is substantially the same as the display apparatus according to the previous example embodiment explained referring to FIGS. 5 to 8 except for the structure of the pixel circuit. Thus, the same reference numerals will be used to refer to the same or like parts as those described in the previous example embodiment of FIGS. 5 to 8 and any repetitive explanation concerning the above elements will be omitted.

Referring to FIGS. 1 and 6 to 10, the display apparatus includes a display panel 100 and a display panel driver. The display panel driver includes a driving controller 200, a gate driver 300, a gamma reference voltage generator 400 and a data driver 500. The display panel driver further includes a power voltage generator 600.

In the present example embodiment, a first pixel, a second pixel and a third pixel of the display panel 100 may be connected to a single sensing line SL.

Referring to FIG. 9, unlike FIG. 5, in the present example embodiment, the control electrode of the fourth switching element TDR may not be connected to the input electrode of the second switching element T2R. The control electrode of the eighth switching element TDG may not be connected to the input electrode of the sixth switching element T2G. The control electrode of the twelfth switching element TDB may not be connected to the input electrode of the tenth switching element T2B.

The third signal STD[R] may be applied to the control electrode of the fourth switching element TDR. The fourth signal STD[G] may be applied to the control electrode of the eighth switching element TDG. The fifth signal STD[B] may be applied to the control electrode of the twelfth switching element TDB. In the present example embodiment, the third signal STD[R] may be independently generated from the first data voltage VDATA[R], the fourth signal STD[G] may be independently generated from the second data voltage VDATA[G], and the fifth signal STD[B] may be independently generated from the third data voltage VDATA[B].

As shown in FIG. 10, an active period of the third signal STD[R] may overlap with an active period of the first data voltage VDATA[R] in the first sensing period SENSE[R], an active period of the fourth signal STD[G] may overlap with an active period of the second data voltage VDATA[G] in the second sensing period SENSE[G], and an active period of the fifth signal STD[B] may overlap with an active period of the third data voltage VDATA[B] in the third sensing period SENSE[B].

Although the active period of the third signal STD[R] is the same as the active period of the first data voltage VDATA[R], the active period of the fourth signal STD[G] is the same as the active period of the second data voltage VDATA[G], and the active period of the fifth signal STD[B] is the same as the active period of the third data voltage VDATA[B] in FIG. 10, the present inventive concept may not be limited thereto. The active period of the third signal STD[R] may be partially overlapped with the active period of the first data voltage VDATA[R], the active period of the fourth signal STD[G] may be partially overlapped with the active period of the second data voltage VDATA[G] and the active period of the fifth signal STD[B] may be partially overlapped with the active period of the third data voltage VDATA[B]

In addition, when the third signal STD[R], the fourth signal STD[G] and the fifth signal STD[B] are independently generated from the first data voltage VDATA[R], the second data voltage VDATA[G] and the third data voltage VDATA[B], respectively, the third signal STD[R], the fourth signal STD[G] and the fifth signal STD[B] may be inactivated in the driving period.

According to the present example embodiment, the pixel includes the first sensing switching element T3R, T3G and T3B and the second sensing switching element TDR, TDG and TDB connected to the first sensing switching element T3R, T3G and T3B in series. The control signal STD[R], STD[G] and STD[B] of the second sensing switching element TDR, TDG and TDB has an active period overlapped with the data voltage VDATA[R], VDATA[G] and VDATA [B] of the pixel such that the sensing accuracy of the voltage of the pixel may be enhanced. Thus, the compensation accuracy of the threshold voltage VTH(T1R), VTH(T1G) and VTH(T1B) of the switching element T1R, T1G and T1B of the pixel may be enhanced such that the display quality of the display panel 100 may be enhanced.

According to the present inventive concept as explained above, the display quality of the display panel may be enhanced.

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A pixel circuit comprising a first pixel, the first pixel comprising:

a first switching element including a control electrode connected to a first node, an input electrode which receives a first power voltage and an output electrode connected to a second node;

a second switching element including a control electrode which receives a first signal, an input electrode which receives a first data voltage and an output electrode connected to the first node;

a first light emitting element including a first electrode connected to the second node and a second electrode which receives a second power voltage;

a third switching element including a control electrode which receives a second signal, an input electrode connected to the second node and an output electrode connected to a third node; and a fourth switching element including a control electrode which receives a third signal, an input electrode connected to the third node and an output electrode connected to a sensing line, wherein the third signal is the same as the first data voltage.

2. The pixel circuit of claim 1, wherein an active period of the third signal overlaps with an active period of the first data voltage.

3. The pixel circuit of claim 1, wherein the control electrode of the fourth switching element is connected to the input electrode of the second switching element.

4. The pixel circuit of claim 1, further comprising a second pixel and a third pixel, wherein the second pixel comprises:

a fifth switching element including a control electrode connected to a fourth node, an input electrode which receives the first power voltage and an output electrode connected to a fifth node;

a sixth switching element including a control electrode which receives the first signal, an input electrode which receives a second data voltage having a phase different from a phase of the first data voltage, and an output electrode connected to the fourth node;

a second light emitting element including a first electrode connected to the fifth node and a second electrode which receives the second power voltage;

a seventh switching element including a control electrode which receives the second signal, an input electrode connected to the fifth node and an output electrode connected to a sixth node; and an eighth switching element including a control electrode which receives a fourth signal, an input electrode connected to the sixth node and an output electrode connected to the sensing line, wherein the third pixel comprises:

a ninth switching element including a control electrode connected to a seventh node, an input electrode receiving the first power voltage and an output electrode connected to an eighth node;

a tenth switching element including a control electrode which receives the first signal, an input electrode receiving a third data voltage having a phase different from either of the phase of the first data voltage and the phase of the second data voltage and an output electrode connected to the seventh node;

a third light emitting element including a first electrode connected to the eighth node and a second electrode which receives the second power voltage;

an eleventh switching element including a control electrode which receives the second signal, an input electrode connected to the eighth node and an output electrode connected to a ninth node; and a twelfth switching element including a control electrode receiving a fifth signal, an input electrode connected to the ninth node and an output electrode connected to the sensing line.

5. The pixel circuit of claim 4, wherein an active period of the third signal overlaps with an active period of the first data voltage, wherein an active period of the fourth signal overlaps with an active period of the second data voltage, and wherein an active period of the fifth signal overlaps with an active period of the third data voltage.

6. The pixel circuit of claim 5, wherein the active period of the third signal, the active period of the fourth signal, and the active period of the fifth signal do not overlap with one another.

7. The pixel circuit of claim 4, wherein the control electrode of the fourth switching element is connected to the input electrode of the second switching element, wherein the control electrode of the eighth switching element is connected to the input electrode of the sixth switching element, and wherein the control electrode of the twelfth switching element is connected to the input electrode of the tenth switching element.

8. The pixel circuit of claim 4, wherein the first light emitting element represents a first color, wherein the second light emitting element represents a second color different from the first color, and wherein the third light emitting element represents a third color different from either of the first color and the second color.

9. A display apparatus comprising:

a display panel comprising a first pixel and which displays an image; and a data driver which outputs a data voltage to the display panel and receives a sensing voltage from the display panel;

wherein the first pixel comprises:

a first switching element including a control electrode connected to a first node, an input electrode which receives a first power voltage and an output electrode connected to a second node;

a second switching element including a control electrode which receives a first signal, an input electrode which receives a first data voltage and an output electrode connected to the first node;

a first light emitting element including a first electrode connected to the second node and a second electrode which receives a second power voltage;

a third switching element including a control electrode which receives a second signal, an input electrode connected to the second node and an output electrode connected to a third node; and a fourth switching element including a control electrode which receives a third signal, an input electrode connected to the third node and an output electrode connected to a sensing line, wherein the data driver comprises:

a first switch including a first end connected to the sensing line and a second end which receives an initialization voltage, the first switch controlled by a first sensing signal; and a second switch connected to the first switch and controlled by a second sensing signal, and wherein the third signal is the same as the first data voltage.

10. The display apparatus of claim 9, wherein an active period of the third signal overlaps with an active period of the first data voltage.

11. The display apparatus of claim 9, wherein the control electrode of the fourth switching element is connected to the input electrode of the second switching element.

12. The display apparatus of claim 9, wherein the first signal, the second signal, the first data voltage, the third signal and the first sensing signal have active statuses in a first period of a sensing period, and wherein the second sensing signal has an inactive status in the first period of the sensing period.

13. The display apparatus of claim 12, wherein the first signal, the second signal, the first data voltage, the third signal, the first sensing signal and the second sensing signal have the active statuses in a second period of the sensing period subsequent to the first period.

14. The display apparatus of claim 13, wherein the first signal, the second signal, the first data voltage, the third signal and the second sensing signal have the active statuses in a third period of the sensing period subsequent to the second period, wherein the first sensing signal has the inactive status in the third period of the sensing period.

15. The display apparatus of claim 14, wherein the first signal, the second signal, the first data voltage and the third signal have the active statuses in a fourth period of the sensing period subsequent to the third period, wherein the first sensing signal and the second sensing signal have the inactive statuses in the fourth period of the sensing period.

16. The display apparatus of claim 14, wherein the first signal is applied to the first pixel in a scanning driving method in a driving period, wherein the first data voltage and the third signal have a value corresponding to a desired grayscale value of the first pixel in the driving period, and wherein the second signal, the first sensing signal and the second sensing signal have the inactive statuses in the driving period.

17. The display apparatus of claim 9, further comprising a driving controller which determines a threshold voltage of the first switching element of the first pixel based on the sensing voltage received from the sensing line and compensates a data signal based on the threshold voltage.

18. The display apparatus of claim 9, wherein the display panel further comprises a second pixel and a third pixel, wherein the second pixel comprises:

a fifth switching element including a control electrode connected to a fourth node, an input electrode which receives the first power voltage and an output electrode connected to a fifth node;

a sixth switching element including a control electrode which receives the first signal, an input electrode which receives a second data voltage having a phase different from a phase of the first data voltage, and an output electrode connected to the fourth node;

a second light emitting element including a first electrode connected to the fifth node and a second electrode which receives the second power voltage;

a seventh switching element including a control electrode which receives the second signal, an input electrode connected to the fifth node and an output electrode connected to a sixth node; and an eighth switching element including a control electrode which receives a fourth signal, an input electrode connected to the sixth node and an output electrode connected to the sensing line wherein the third pixel comprises:

a ninth switching element including a control electrode connected to a seventh node, an input electrode receiving the first power voltage and an output electrode connected to an eighth node;

a tenth switching element including a control electrode which receives the first signal, an input electrode receiving a third data voltage having a phase different from either of the phase of the first data voltage and the phase of the second data voltage, and an output electrode connected to the seventh node;

a third light emitting element including a first electrode connected to the eighth node and a second electrode which receives the second power voltage;

an eleventh switching element including a control electrode which receives the second signal, an input electrode connected to the eighth node and an output electrode connected to a ninth node; and a twelfth switching element including a control electrode receiving a fifth signal, an input electrode connected to the ninth node and an output electrode connected to the sensing line.

19. The display apparatus of claim 18, wherein an active period of the third signal overlaps with an active period of the first data voltage, wherein an active period of the fourth signal overlaps with an active period of the second data voltage, and wherein an active period of the fifth signal overlaps with an active period of the third data voltage.

20. The display apparatus of claim 19, wherein the active period of the third signal, the active period of the fourth signal and the active period of the fifth signal do not overlap with one another.

* * * * *